United States Patent [19]

Byrne

[11] Patent Number: 5,014,427

[45] Date of Patent: May 14, 1991

[54] DISPOSABLE SHAVER

[76] Inventor: James C. Byrne, 934 Stuyvesant Ave., Union, N.J. 08611

[21] Appl. No.: 486,254

[22] Filed: Jan. 28, 1990

[51] Int. Cl.[5] ..... B26B 21/44

[52] U.S. Cl. ..... 30/41; 30/47; 30/86

[58] Field of Search ..... 30/41, 86, 32, 47

[56] References Cited

U.S. PATENT DOCUMENTS

| | | | |
|---|---|---|---|
| 1,892,836 | 1/1933 | Harvey | 30/41 |
| 2,037,588 | 4/1936 | Pica | 30/41 |
| 4,625,402 | 12/1986 | Kavoussi | 30/41 |

FOREIGN PATENT DOCUMENTS

| | | | |
|---|---|---|---|
| 1208653 | 1/1966 | Fed. Rep. of Germany | 30/32 |
| 2619333 | 2/1989 | France | 30/41 |
| 653595 | 1/1986 | Switzerland | 30/41 |

*Primary Examiner*—Douglas D. Watts
*Assistant Examiner*—John M. Husar
*Attorney, Agent, or Firm*—Martin R. Oliveras

[57] ABSTRACT

A disposable shaver includes a primary plunger structure in the pre-rotated position and in the post-rotated position. The disposable shaver comprises: the primary plunger structure; and a handle-shaver head structure. The primary plunger structure further comprises: a plurality of longitudinally directed ribs; and a transversely directed disc structure. The disc structure includes a middle circular disc being a layer of styptic material. The handle-shaver head structure further comprises: a rotatable member; a handle member; a primary plunger holder; and a shaver head. The shaver head includes a rear conduit opening. The primary plunger structure is rotatable about a transverse axis defined by the flexible extension of the rotatable member in order to be inserted into such handle member. The primary plunger structure further comprises a primary plunger end which includes upper piercing means. The handle-shaver head structure further comprises a secondary plunger which is fully retracted within the handle member when in the pre-packaged position and which is fully inserted within the handle member after full discharge of the pre-enclosed shaving gel. The handle member includes a conduit which leads to the shaver head conduit opening.

4 Claims, 3 Drawing Sheets

DISPOSABLE SHAVER

FIELD OF THE INVENTION

This invention relates to shaving devices and in particular to a disposable shaver which includes a shaving lather container.

DISCUSSION OF THE PRIOR ART

The prior art discloses several medical and surgical instruments such as:

a. Eyraud U.S. Pat. No. 1,449,594 entitled "Safety Razor" which discloses such a safety razor comprising a hollow cylindrical handle, blade supporting and adjusting means, a threaded closure plug, a threaded recess, and a styptic pencil;

b. Pica U.S. Pat. No. 2,037,588, entitled "Safety Razor" which discloses such a safety razor comprising a hollow handle, a piston, a plug, a central bore, outwardly directed ports, an annular flared guard, a boss, a cap plate, and parallel elongated slots;

c. Cooney U.S. Pat. No. 2,392,975 entitled "Cream Fountain Razor" which discloses such a fountain safety razor comprising a backing member, a water reservoir, apertures, and cream forcing means;

d. Perez U.S. Pat. No. 3,703,765; entitled "Disposable Razor" which discloses such a disposable razor comprising a plastic head member, a blade, a cylindrical stem, a coaxial bore, an outlet aperture, a hollow handle, and a predetermined quantity of shaving lather;

e. Cataudella U.S. Pat. No. 4,716,652 entitled "Disposable Shaver" which discloses such a disposable shaver comprising a shaving head, a unified handle, a shaving lubricant container, a blade, blade holding means, an elongated hollow shaving lubricant container, a bore, a closable opening, a slot, a thin rupturable membrane, membrane rupturing means, shaving lubricant pushing means, and manual engagement means; and f. Cataudella U.S. Pat. No. 4,800,649, entitled "Disposable Shaver" which discloses such a disposable shaver comprising a shaving head element, a unified handle, a shaving lubricant container, an elongated substantially rigid handle member, a common wall, oppositely disposed longitudinally corrugated collapsible walls, and closeable aperture means.

The above cited prior art patents do not disclose the disposable shaver of the present invention as will be apparent from the following disclosure.

Objects of the present invention are therefore:

a. to provide a disposable shaver which includes a styptic pencil being an integral part of the primary plunger structure;

b. to provide a disposable shaver which includes a shaving gel or cream container being an integral part of the handle-shaver head structure;

c. to provide a disposable shaver which includes a secondary plunger being an integral part of the handle-shaver head structure;

d. to provide a disposable shaver which includes a conduit or channel connecting the handle member shaving lather container and the external surface of the shaving head;

e. to provide a disposable shaver wherein the primary plunger structure is rotatable relative to the handle-shaver head structure; and f. to provide such a disposable shaver which is simple, inexpensive, and compact.

SUMMARY AND FEATURES OF THE PRESENT INVENTION

A summary and features of the present invention are that:

a. the disposable shaver includes the primary plunger structure in the pre-rotated position and in the post-rotated position;

b. the disposable shaver comprises: the primary plunger structure; and the handle-shaver head structure;

c. the primary plunger structure further comprises: a plurality of longitudinally directed ribs; and a transversely directed disc structure;

c. such disc structure includes a middle circular disc being a layer of styptic material;

d. such handle-shaver head structure further comprises: a rotatable member; a handle member; a primary plunger holder; and a shaver head;

e. such shaver head includes a rear conduit opening;

f. such primary plunger structure is rotatable about a transverse axis defined by the flexible extension of the rotatable member in order to be inserted into such handle member;

g. such primary plunger structure further comprises a primary plunger end which includes upper piercing means;

h. such handle-shaver head structure further comprises a secondary plunger which is fully retracted within the handle member when in the pre-packaged position and which is fully inserted within the handle member after full discharge of the pre-enclosed shaving gel;

i. such handle member includes a conduit which leads to the shaver head conduit opening;

j. such secondary plunger is in the fully inserted position when such primary plunger is in the fully inserted position and such secondary plunger is in the fully retracted position when such primary plunger is initially in the fully retracted position;

k. such primary plunger structure is pre-packaged external to such handle-shaver head structure and such secondary plunger structure is pre-packaged internal to such handle member;

l. the conical surface and the toroidal surface of such secondary plunger are adapted to contact the inner cylindrical surface of such handle member;

m. the above described structure may be made of formable plastic or other suitable material except for the removable foil covers, the styptic disc, and the and pre-enclosed shaving gel.

BRIEF DESCRIPTION OF THE DRAWING

The above and other objects, features, and advantages of the present invention will be better appreciated from a reading of the following detailed description with reference to the drawing in which.

DETAILED DESCRIPTION OF THE PRESENT INVENTION

Figure 1:
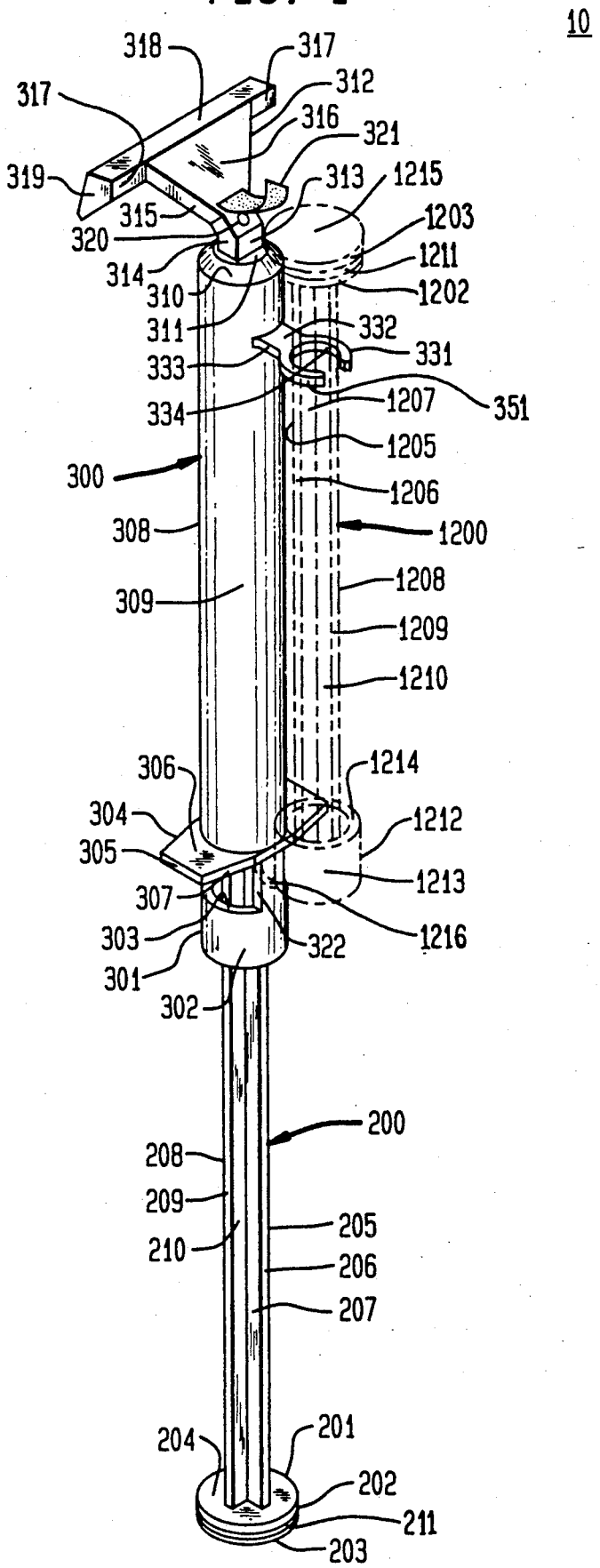
FIG. 1 is a perspective view of the disposable shaver according to the present invention showing the primary plunger structure in the pre-rotated position in phantom view and in the post-rotated position.

FIG. 1 is a perspective view of disposable shaver 10 according to the present invention showing primary plunger structure 1200 when in the pre-rotated position in phantom view and primary plunger structure 200 when in the post-rotated position. Shaver 10 comprises: primary plunger structure 1200 in the pre-rotated position in phantom view; primary plunger structure 200 in the post-rotated position; and handle-shaver head structure 300. Primary plunger structure 200 in the post-rotated position further comprises: longitudinally directed first rib 205; transversely directed disc structure 201; and longitudinally directed second rib 208. Rib 205 includes circumferentially directed surface 206 and radially directed surface 207. Disc structure 201 includes: upper disc 202 being rigidly connected to ribs 205 and 208; middle circular disc 211 being a layer of styptic material and being adhesively connected to disc 202; and lower circular disc 203 being a layer of removable foil cover for disc 211. Disc 202 further includes upper surface 204. Rib 208 includes circumferentially directed surface 209 and radially directed surface 210. Primary plunger structure 1200 in the pre-rotated position further comprises: disc 1203 including circular surface 1215; disc 1211; disc 1202; third rib 1208 including circumferentially directed surface 1209 and radially directed surface 1210; and second rib 1205 including circumferentially directed surface 1206 and radially directed surface 1207. Rib 1205 in the pre-rotated position corresponds to rib 208 in the post-rotated position; while disc 1203 corresponds to disc 203; disc 1202 corresponds to disc 202; and disc 1211 corresponds to disc 211.

Handle-shaver head structure 300 further comprises: rotatable member 1212 when in the pre-rotated position; rotatable member 301 in the post-rotated position; finger grip member 304; handle member 308; primary plunger holder 331; and shaver head 312. Member 301 includes longitudinally directed outer cylindrical surface 302, flexible extension 322, and surface 303. Member 1212 in the pre-rotated position includes annular surface 1214, longitudinally directed outer cylindrical surface 1213, and flexible extension 1216. Surface 1213 in the pre-rotated position corresponds to surface 302 in the post-rotated position; while flexible extension 1216 in the pre-rotated position corresponds to flexible extension 322 in the post-rotated position. Handle member 308 includes longitudinally directed outer cylindrical surface 309, outer conical surface 310, and upper surface 311. Member 304 includes transverse surface 305; transverse surface 307, and upper surface 306. Holder 331 includes upper surface 332, longitudinally directed inner cylindrical surface 334, lateral surface 333, and longitudinally directed outer cylindrical surface 351. Shaver head 312 includes lateral surface 314, lateral surface 315, rear surfaces 317, lateral surface 319, upper surface 318, upper surface 316, rear surface 313, conduit opening 320, and removable foil cover 321. Primary plunger 1200 structure when in the pre-rotated position is rotatable about a transverse axis defined by flexible extension 1216 to end up in the post-rotated position as primary plunger 200 being inserted into handle member 308. Flexible extension 1216 and flexible extension 322 are one and the same.

Figure 2:
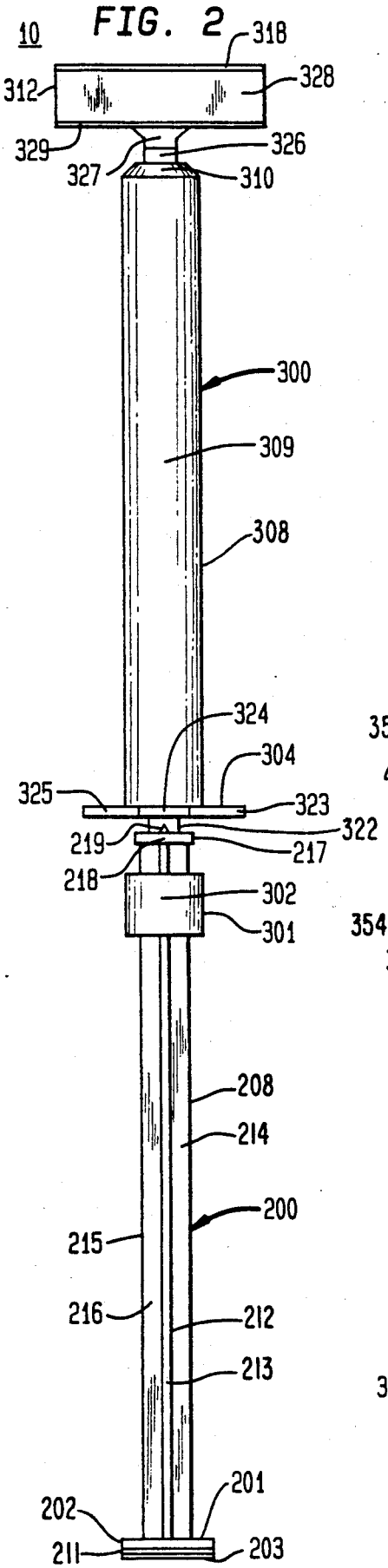
FIG. 2 is a front view of the disposable shaver showing the primary plunger structure in the post-rotated position.

FIG. 2 is a front view of disposable shaver 10 showing primary plunger structure 200 in the post-rotated position. Shaver 10 comprises: primary plunger structure 200; and handle-shaver head structure 300. Structure 200 further comprises: disc structure 201; second rib 208; third rib 212; fourth rib 215; and primary plunger end 217. Second rib 208 includes radially directed surface 214. Third rib 212 includes circumferentially directed surface 213. Fourth rib 215 includes radially directed surface 216. Disc structure 201 includes upper disc 202, middle disc 211, and lower disc 203. Primary plunger end 217 includes longitudinally directed outer cylindrical surface 218 and upper piercing means 219. Handle-shaver head structure 300 further comprises: rotating member 301; finger grip member 304; handle member 308; and shaver head 312. Finger grip member 304 includes lateral surface 325, lateral surface 324, and lateral surface 323. Rotating member 301 includes flexible extension 322 and longitudinally directed outer cylindrical surface 302. Handle member 308 includes longitudinally directed outer cylindrical surface 309 and outer conical surface 310. Shaver head 312 includes upper surface 318, front surface 328, lower surface 329, front surface 327, and front surface 326.

Figure 3:
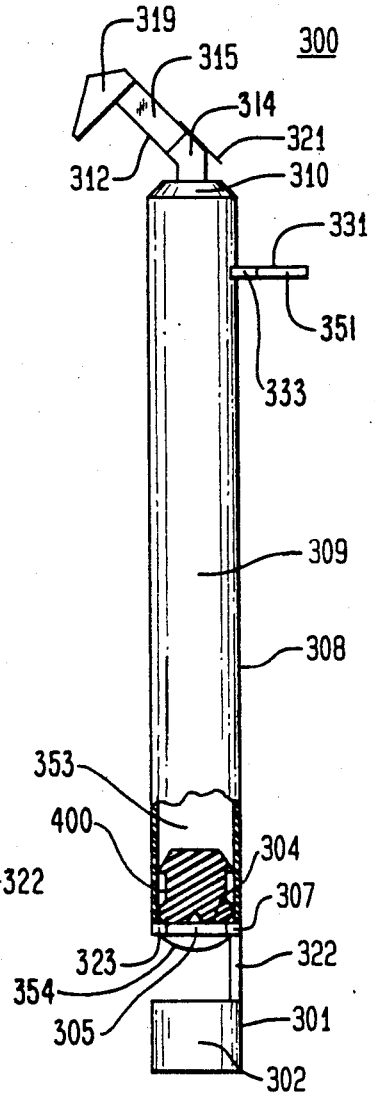
FIG. 3 is a partially cross-sectional side view of the handle-shaver head structure showing the secondary plunger in the fully retracted position.

FIG. 3 is a partially cross-sectional side view of handle-shaver head structure 300 showing secondary plunger 400 in the fully retracted position. Handle-shaver head structure 300 further comprises: rotating member 301; finger grip member 304; handle member 308; secondary plunger 400; primary plunger holder 331; and shaver head 312. Rotating member 301 includes longitudinally directed outer cylindrical surface 302 and flexible extension 322. Finger grip member 304 includes lateral surface 323, lateral surface 305, and lateral surface 307. Handle member 308 includes longitudinally directed outer cylindrical surface 309, prepackaged shaving gel or cream 353, pierceable foil cover 354, and outer conical surface 310. Primary plunger holder 331 includes lateral surface 333 and longitudinally directed outer cylindrical surface 351. Shaver head 312 includes lateral surface 319, lateral surface 315, lateral surface 314, and removable foil cover 321.

Figure 4:
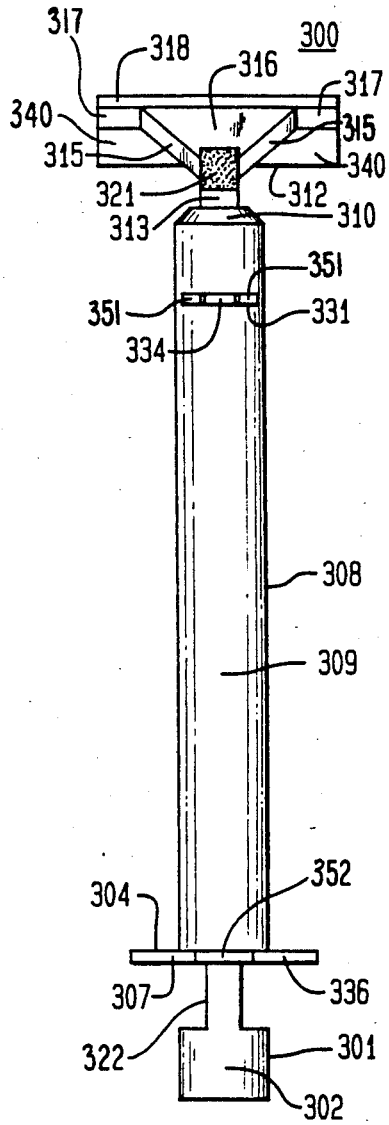
FIG. 4 is a rear view of the handle-shaver head structure.

FIG. 4 is a rear view of handle-shaver head structure 300 further comprising: rotatable member 301; finger grip member 304; handle member 308; primary plunger holder 331; and shaver head 312. Rotatable member 301 includes longitudinally directed outer cylindrical surface 302 and flexible extension 322. Finger grip member 304 includes lateral surface 307, lateral surface 352, and lateral surface 336. Handle member 308 includes longitudinally directed outer cylindrical surface 309 and outer conical surface 310. Primary plunger holder 331 includes longitudinally directed outer cylindrical surfaces 351 and longitudinally directed inner cylindrical surface 334. Shaver head 312 includes upper surface 318, rear surface 316, rear surfaces 317, rear surfaces 340, rear surface 313, removable foil cover 321, and rear surfaces 315.

Figure 5:
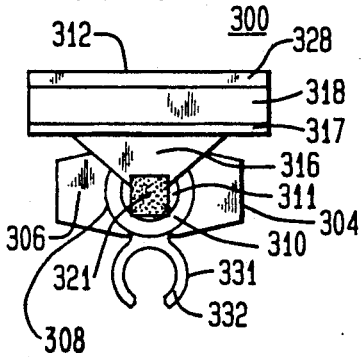
FIG. 5 is a top view of the handle-shaver head structure

FIG. 5 is a top view of handle-shaver head structure 300 showing: upper surface 306 of finger grip member 304; outer conical surface 310 and upper surface 311 of handle member 308; upper surface 332 of primary plunger holder 331; and upper surface 328, upper surface 318, upper surface 317, rear surface 316, and removable foil cover 321 all of shaver head 312.

Figure 6:
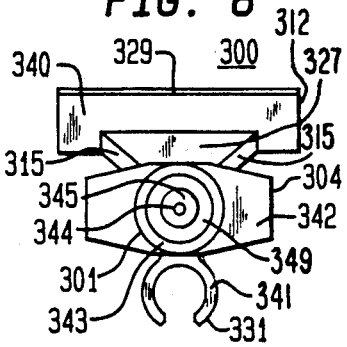
FIG. 6 is a bottom view of the handle-shaver head structure.

FIG. 6 is a bottom view of handle-shaver head structure 300 showing: annular surface 343 of rotatable member 301; lower surface 342 of finger grip member 304; inner conical surface 349, inner annular surface 345, and conduit or hole 344 of handle member 308; lower surface 341 of primary plunger holder 331; and surfaces 315, surface 340, surface 329, and surface 327 all of shaver head 312.

Figure 7:
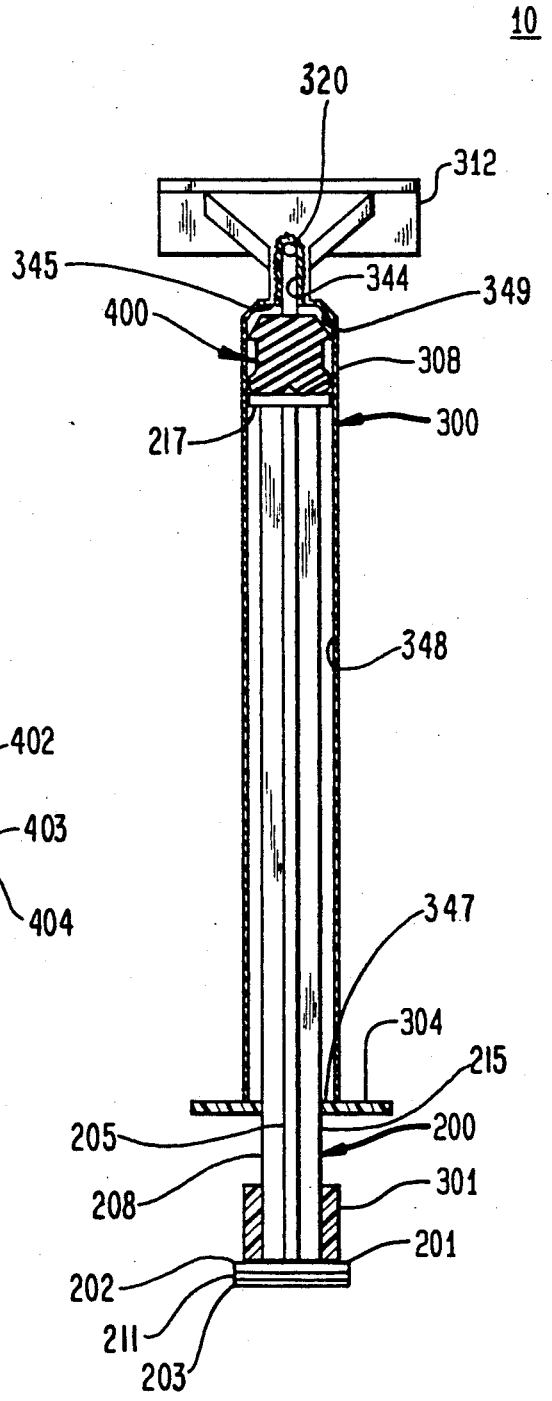
FIG. 7 is a partially cross-sectional rear view of the disposable shaver showing the primary plunger structure in the post-rotated position and showing the secondary plunger and the primary plunger structure in the fully inserted position within the handle-shaver head structure.

FIG. 7 is a partially cross-sectional rear view of disposable shaver 10 showing primary plunger structure 200 in the post-rotated position and being fully inserted within handle-shaver head structure 300 and showing secondary plunger 400 also being fully inserted within handle-shaver head structure 300. Shaver 10 comprises: primary plunger structure 200; handle-shaver head structure 300; and secondary plunger 400. Primary plunger 200 further comprises: lower disc 203; middle disc 211; upper disc 202; first rib 205; second rib 208; third rib 215; and primary plunger end 217. Handle-shaver head structure 300 further comprises: rotatable member 301; finger grip member 304; handle 308; and shaver head 312. Handle member 308 includes conduit 344, inner annular surface 347, longitudinally directed inner cylindrical surface 348, inner annular surface 345, and inner conical surface 349. Conduit 344 is continuous with hole 320 of shaver head 312.

Figure 8:
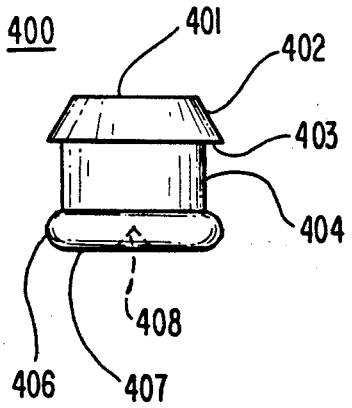
FIG. 8 is a side view of the secondary plunger.

FIG. 8 is a side view of secondary plunger 400 further comprising: upper circular surface 401; outer conical surface 402; lower annular surface 403; longitudinally directed outer cylindrical surface 404; outer toroidal surface 406; lower annular surface 407; and lower conical depression 408. Lower conical depression 408 is adapted to receive upper piercing means 219 of primary plunger end 217.

The following should be noted:

a. the above described structure may be made of formable plastic or other suitable material except for removable foil cover disc 203, styptic disc 211, removable foil cover 354, removable foil cover 321, and pre-enclosed shaving gel 353; and b. shaver head 312 is adapted to include any one of several commercially available blade formats.

While the arrangement according to the present invention has been described in terms of a specific illustrative embodiment, it will be apparent to those skilled in the art that many modifications are possible within the scope and spirit of disclosed principle.

What is claimed is:

1. A disposable shaver comprising:

a. a primary plunger structure and a handle-shaver head structure;

b. said handle-shaver head structure further comprising: a rotatable member including a flexible extension; a hollow handle member including pre-enclosed shaving gel and including a conduit; a primary plunger holder; and a shaver head including a rear conduit opening which is continuous with said hollow handle member conduit;

c. said primary plunger structure being initially in a pre-rotated position and being positionable in a post-rotated position, said primary plunger structure being rotatable about a transverse axis being defined by said rotatable member flexible extension such that said primary plunger structure is insertable within said hollow handle member;

d. said handle-shaver head structure further comprising a secondary plunger;

e. said secondary plunger being fully retracted within said hollow handle member when in the pre-packaged position and being fully inserted within said hollow handle member after full discharge of said pre-enclosed shaving gel;

f. said secondary plunger being fully inserted within said hollow handle member when said primary plunger is fully inserted within said hollow handle member and wherein said secondary plunger being fully retracted within said hollow handle member when said primary plunger is outside said hollow handle member; and g. said primary plunger structure being pre-packaged external to said handle-shaver head structure and said secondary plunger structure being pre-packaged in the fully retracted position within said hollow handle member.

2. The disposable shaver of claim 1 wherein:

said primary plunger structure further comprises a transversely directed disc structure including a middle disc being a layer of styptic material.

3. The disposable shaver of claim 1 wherein:

said primary plunger structure further comprises a primary plunger end which includes upper piercing means.

4. The disposable shaver of claim 1 wherein:

said secondary plunger includes a conical surface and a toroidal surface;

said handle member includes an inner cylindrical surface; and said conical surface and said toroidal surface are adapted to make intimate contact with said inner cylindrical surface.

* * * * *